US006538389B2

(12) United States Patent
Onozawa et al.

(10) Patent No.: US 6,538,389 B2
(45) Date of Patent: Mar. 25, 2003

(54) PLASMA DISPLAY APPARATUS HAVING REDUCED VOLTAGE DROPS ALONG WIRING LINES

(75) Inventors: Makoto Onozawa, Kawasaki (JP); Michitaka Ohsawa, Kawasaki (JP); Takeshi Kuwahara, Kawasaki (JP); Taizo Ohno, Higashimorokata (JP); Yoshimasa Awata, Yokohama (JP); Takayoshi Nakamura, Chiyoda (JP)

(73) Assignees: Hitachi, Ltd., Tokyo (JP); Fujitsu Hitachi Plasma Display Limited, Kawasaki (JP)

( * ) Notice: Subject to any disclaimer, the term of this patent is extended or adjusted under 35 U.S.C. 154(b) by 0 days.

(21) Appl. No.: 09/988,160

(22) Filed: Nov. 19, 2001

(65) Prior Publication Data

US 2002/0101174 A1 Aug. 1, 2002

(30) Foreign Application Priority Data

Dec. 22, 2000 (JP) ..... 2000-391389

(51) Int. Cl.[7] ..... G09G 3/10

(52) U.S. Cl. ..... 315/169.1; 315/169.4; 345/204; 345/213; 345/214

(58) Field of Search ..... 315/169.1, 169.2, 315/169.4; 345/66, 67, 68, 204, 205, 213, 214

(56) References Cited

U.S. PATENT DOCUMENTS 6,281,635 B1 * 8/2001 Lee ..... 315/169.4
6,320,326 B1 * 11/2001 Shino et al. ..... 315/169.4
6,411,268 B1 * 6/2002 Nakamura et al. ..... 345/60
6,456,263 B1 * 9/2002 Hashimoto et al. ..... 345/60

FOREIGN PATENT DOCUMENTS

JP 9-160525 6/1997
JP 11-065520 3/1999

* cited by examiner

*Primary Examiner*—Haissa Philogene
(74) *Attorney, Agent, or Firm*—Staas & Halsey LLP

(57) ABSTRACT

A plasma display apparatus includes a plurality of first electrodes, a plurality of second electrodes which are arranged in substantially parallel to the plurality of first electrodes and generate electric discharge with the plurality of first electrodes at gaps therebetween, a first drive circuit which applies an electric discharge voltage to the plurality of first electrodes, a second drive circuit which applies an electric discharge voltage to the plurality of second electrodes, and voltage fluctuation balancing units which are provided for wiring lines between the first and second drive circuits and the first and second electrodes, and each of which has a conductive plate layer overlapping at least part of the wiring lines so as to reduce a variation in voltage drops specific to the wiring lines by eddy currents generated in the conductive plate layer in response to currents running through the wiring lines.

6 Claims, 17 Drawing Sheets

20 PLASMA DISPLAY PANEL
22
X ELECTRODE DRIVE CIRCUIT
32
VOLTAGE FLUCTUATION BALANCING UNIT
X1
X2
X3
Xn
23
ADDRESS ELECTRODE DRIVE CIRCUIT
An
A3
A1
A2
Y1
Y2
Y3
Yn
SCANNING CIRCUIT
27
y1
y2
y3
yn
31
VOLTAGE FLUCTUATION BALANCING UNIT
21
Y ELECTRODE DRIVE CIRCUIT
26
CONTROL CIRCUIT
25
MEMORY
24
DISCRIMINATION DECISION CIRCUIT
Vsync
Hsync
Clock
R
G
B

PLASMA DISPLAY APPARATUS HAVING REDUCED VOLTAGE DROPS ALONG WIRING LINES

BACKGROUND OF THE INVENTION

1. Field of the Invention

The present invention generally relates to plasma display apparatuses, and particularly relates to a plasma display apparatus that has an improved display quality.

2. Description of the Related Art

Plasma display panels have two glass plates on which electrodes are formed, and discharge-purpose gas fills the gap between the two glass plates that is in the order of 100 microns. Voltages higher than a discharge threshold voltage are applied between the electrodes to start gas discharge, and ultraviolet light generated from the discharge induces the light emission of photo florescent provided on the plate, thereby effecting screen displaying.

FIG. 1 is a diagram showing a schematic configuration of a plasma display apparatus.

A display panel 10 includes X electrodes 11 and Y electrodes 12 disposed in parallel, and further includes address electrodes 13 disposed in perpendicular thereto. The X electrodes 11 and the Y electrodes 12 are used to provide sustain discharge for display-purpose light emission. Voltage pulses are applied between the X electrodes 11 and the Y electrodes 12, thereby carrying out sustain discharge. Further, the Y electrodes 12 serve as scan-purpose electrodes for writing display data. The address electrodes 13 are used to select display cells 15 that are to emit light. A voltage for writing discharge is applied between the Y electrodes 12 and the address electrodes 13 so as to select discharge cells. Shields 14 are provided between the address electrodes 13 for the purpose of separating the discharge cells 15.

Discharge of a plasma display panel can only assume either one of the "on" state and the "off" state, so that the density, i.e., the gray scale, is represented by the number of repeated light emissions. To this end, a frame is divided into 10 sub-fields, for example. Each sub-field is comprised of a reset period, an address period, and a sustain discharge period. During the reset period, all cells are equally initialized regardless of lighting status in the previous sub-fields, e.g., are placed in the condition in which wall charge is erased. During the address period, selective discharge (addressing discharge) is performed to select the on/off states of cells in accordance with display data, thereby selectively generating wall charge that places cells in the "on" state. During the sustain discharge period, discharge is repeated in the cells where addressing discharge was performed to generate wall discharge, thereby emitting light. The length of the sustain discharge period, i.e., the number of repeated light emissions, differs from sub-field to sub-field. For example, ratios of the numbers of light emissions from the first sub-field to the tenth sub-field are set to 1:2:4:8: . . . :512, respectively. Sub-fields are then selected in accordance with the luminance level of a display cell to be subjected to gas discharge, thereby achieving a desired gray scale level.

FIG. 2 is a drawing showing another configuration of a display panel unit different from that of FIG. 1.

In a display panel unit 10A of FIG. 2, X electrodes 11A and Y electrodes 12A serving as display electrodes are provided in turn at equal intervals so as to cross address electrodes 13A. All gaps between the electrodes are utilized as display lines (L1, L2, . . . ). This configuration is called an ALIS (alternate lightning of surfaces) method, and is disclosed in Japanese Patent No. 2801893. Since all the gaps between the electrodes are utilized as display lines, the number of electrodes is half as many as that of FIG. 2, which provides a basis for a cost reduction and a scale reduction.

Since all the gaps between electrodes serve as display lines in the ALIS method, it is impossible to light up all the display lines simultaneously. Lighting of odd-number lines (L1, L3, . . . ) and even-number lines (L2, L4, . . . ) are temporally separated to effect displaying. In the ALIS method, One frame is divided into two fields, each of which is comprised of a plurality of sub-fields. The first field is used for the displaying of odd-number lines, and the second field is used for the displaying of even-number lines.

FIG. 3 is a drawing showing a configuration of a related-art plasma display apparatus.

The plasma display apparatus of FIG. 3 includes a plasma display panel 20, a Y electrode drive circuit 21, an X electrode drive circuit 22, an address electrode drive circuit 23, a discrimination decision circuit 24, a memory 25, a control circuit 26, and a scanning circuit 27.

A vertical synchronizing signal Vsync, a horizontal synchronizing signal Hsync, a clock signal Clock, and RGB signals each comprised of 8 bits and serving as data signals are supplied to the discrimination decision circuit 24. The discrimination decision circuit 24 writes RGB data in the memory 25 as display data in response to the vertical synchronizing signal Vsync. The control circuit 26 controls the Y electrode drive circuit 21, the X electrode drive circuit 22, the address electrode drive circuit 23, and the scanning circuit 27, and displays the display data stored in the memory 25 on the plasma display panel 20. In conjunction with this, the scanning circuit 27 scans the Y electrodes Y1 through Yn, and the address electrode drive circuit 23 drives the address electrodes A1 through An, thereby together effecting writing electric discharge for writing data in the plasma display panel 20. In the display cells where data were written, further, sustain electric discharge is generated between the Y electrodes Y1 through Yn and the X electrodes X1 through Xn by the Y electrode drive circuit 21 and the X electrode drive circuit 22.

In the related-art configuration shown in FIG. 3, lines y1 through yn that extends from the Y electrode drive circuit 21 to the scanning circuit 27 to be connected to the Y electrodes Y1 through Yn take different wiring paths between the Y electrode drive circuit 21 and the scanning circuit 27, so that they have different wire lengths. In the example of FIG. 3, similarly, the X electrodes X1 through Xn extending from the X electrode drive circuit 22 to the plasma display panel 20 take different wiring paths to have different wire lengths. The line y1 and the Y electrode Y1 connected thereto both having long wiring lengths have wiring resistance and wiring inductance larger than those of the line y3 and the Y electrode Y3 connected thereto both having relatively short wiring lengths. By the same token, the X electrode X1 having a long wiring length has wiring resistance and wiring inductance larger than those of the X electrode X3 having a relatively short wiring length. An effect of the wiring inductance is especially strong. Because of this, when an electric current runs through wiring lines and electrodes to generate electric discharge between the Y electrodes Y1 through Yn and the X electrodes X1 through Xn, a voltage drop occurs along the wiring lines and electrodes. The voltage drop generated in this manner differs from wiring line to wiring line and from electrode to electrode.

As a result of this voltage drop, when a sufficient margin cannot be secured for the discharge voltage of a plasma display panel with respect to the electrodes having a large voltage drop, a sufficient voltage required to light up an electric discharge may not be supplied. In such a case, a flicker of a screen or the like will appear, thereby degrading display quality.

Accordingly, the present invention is aimed at providing a plasma display panel in which a voltage drop produced in accordance with a wire length is reduced. Moreover, the present invention is aimed at providing a plasma display panel in which a variation in voltage drops produced according to wire lengths is reduced, thereby improving the quality of images.

SUMMARY OF THE INVENTION

It is a general object of the present invention to provide a plasma display apparatus that substantially obviates one or more of the problems caused by the limitations and disadvantages of the related art.

In order to achieve the above objects according to the present invention, a plasma display apparatus includes a plurality of first electrodes, a plurality of second electrodes which are arranged in substantially parallel to the plurality of first electrodes and generate electric discharge with the plurality of first electrodes at gaps therebetween, a first drive circuit which applies an electric discharge voltage to the plurality of first electrodes, a second drive circuit which applies an electric discharge voltage to the plurality of second electrodes, and voltage fluctuation balancing units which are provided for wiring lines between the first and second drive circuits and the first and second electrodes, and each of which has a conductive plate layer overlapping at least part of the wiring lines so as to reduce a variation in voltage drops specific to the wiring lines by eddy currents generated in the conductive plate layer in response to currents running through the wiring lines.

Alternatively, the voltage fluctuation balancing units each include a reverse current line laid out along one of the wiring lines and having a current running therethrough in a direction opposite to a current running through the one of the wiring lines so as to reduce a variation in voltage drops specific to the wiring lines.

Alternatively, the voltage fluctuation balancing units each apply a voltage to at least one of the wiring lines where the applied voltage has an identical polarity to a voltage applied to the at least one of the wiring lines, thereby reducing a variation in voltage drops specific to the wiring lines.

The configurations as described above provide a plasma display panel apparatus in which a variation in voltage drops produced in accordance with wire lengths is reduced, thereby improving the quality of images.

According to another aspect of the present invention, a plasma display apparatus includes a plurality of first electrodes, a plurality of second electrodes which are arranged in substantially parallel to the plurality of first electrodes and generate electric discharge with the plurality of first electrodes at gaps therebetween, a first drive circuit which applies an electric discharge voltage to odd-number electrodes of the plurality of first electrodes, and a second drive circuit which applies an electric discharge voltage to even-number electrodes of the plurality of first electrodes, wherein the first drive circuit and the second drive circuit have a mutually symmetrical input/output pin arrangement.

Such s symmetrical pin arrangement makes it possible to lay out wiring lines in a balanced arrangement, thereby efficiently reducing voltage drops caused by the wiring inductance and balancing the voltage drops.

According to another aspect of the present invention, a plasma display apparatus includes a plurality of first electrodes, a plurality of second electrodes which are arranged in substantially parallel to the plurality of first electrodes and generate electric discharge with the plurality of first electrodes at gaps therebetween, a first integrated circuit which includes a high-side odd-number electrode drive circuit for supplying a high voltage to odd-number electrodes of the first electrodes and a low-side even-number electrode drive circuit for supplying a low voltage to even-number electrodes of the first electrodes, and a second integrated circuit which includes a low-side odd-number electrode drive circuit for supplying a low voltage to the odd-number electrodes of the first electrodes and a high-side even-number electrode drive circuit for supplying a high voltage to the even-number electrodes of the first electrodes.

In the invention described above, each electrode drive circuit is divided into an H-side circuitry and an L-side circuitry, and electrode drive circuits and wiring lines are arranged such that currents run in opposite directions between adjacent wiring lines at each electric discharge timing. This makes it possible to cut down the influence of wiring inductance.

According to another aspect of the present invention, a plasma display apparatus, which includes a plurality of first electrodes and a plurality of second electrodes that are arranged in substantially parallel to the plurality of first electrodes and generate electric discharge with the plurality of first electrodes at gaps therebetween, includes a plurality of blocks into which the plurality of first electrodes are divided, wherein each block is provided with an odd-number electrode drive circuit for driving odd-number electrodes of the first electrodes and an even-number electrode drive circuit for driving even-number electrodes of the first electrodes.

In the invention described above, each electrode drive circuit is divided into a plurality of circuitries, and electrode drive circuits and wiring lines are arranged such that currents run in opposite directions between adjacent wiring lines at each electric discharge timing. This makes it possible to cut down the influence of wiring inductance.

Other objects and further features of the present invention will be apparent from the following detailed description when read in conjunction with the accompanying drawings.

DESCRIPTION OF THE PREFERRED EMBODIMENTS

In the following, embodiments of the present invention will be described with reference to the accompanying drawings.

Figure 3:
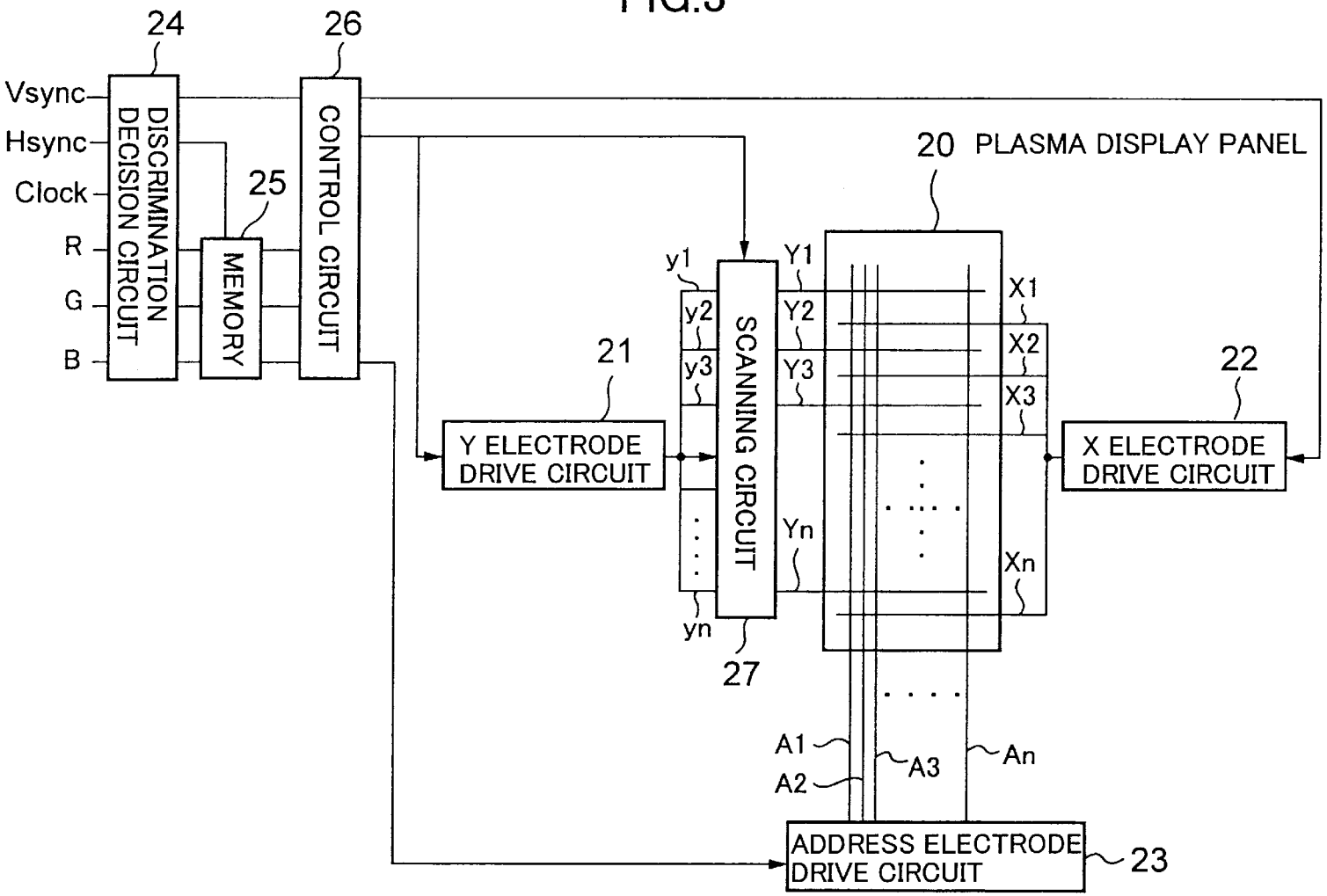
FIG. 3 is a drawing showing a configuration of a related-art plasma display apparatus.
Figure 4:
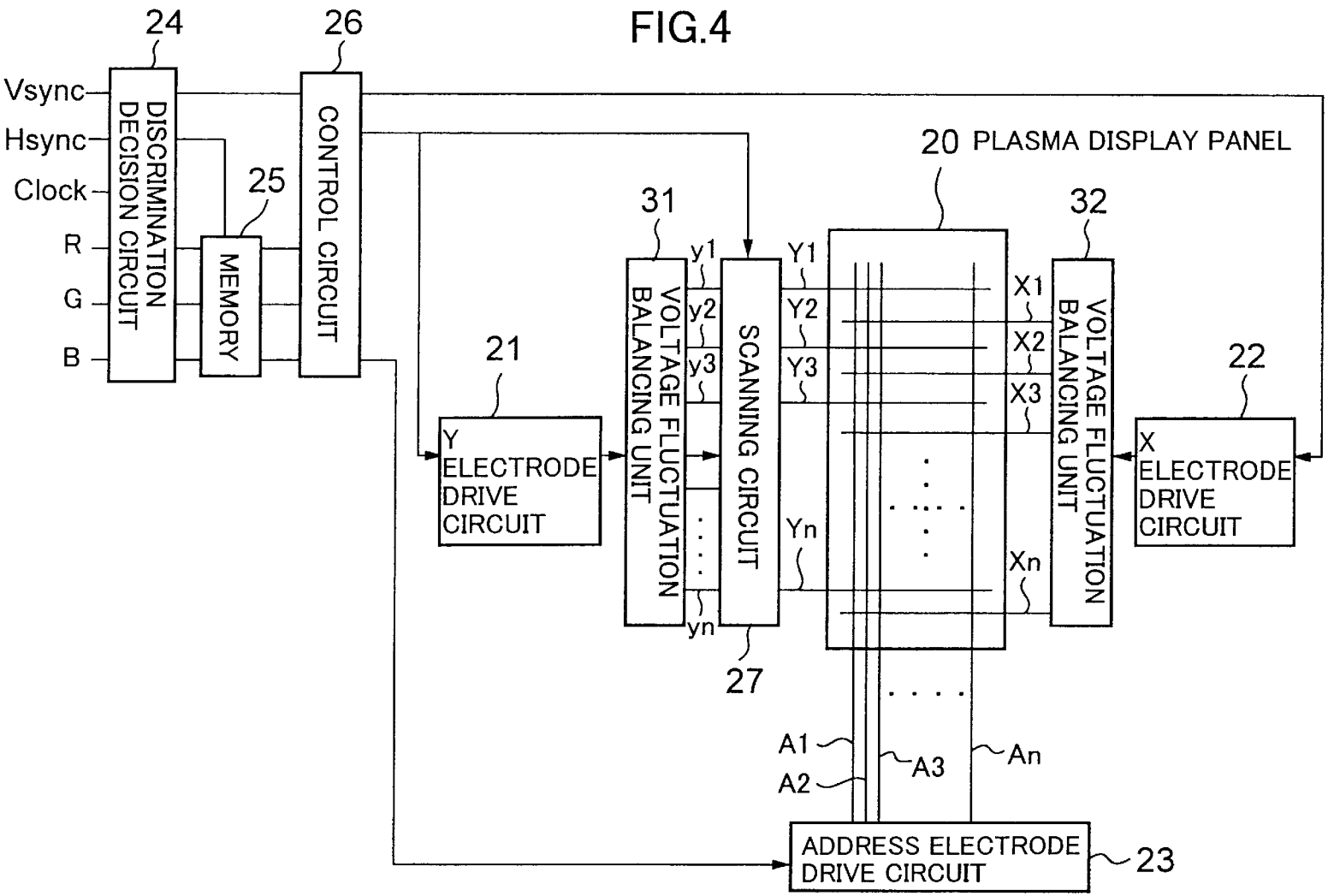
FIG. 4 is a drawing showing a configuration of a plasma display apparatus according to the present invention.

FIG. 4 is a drawing showing a configuration of a plasma display apparatus according to the present invention. In FIG. 4, the same elements as those of FIG. 3 are referred to by the same numerals.

The plasma display apparatus of FIG. 4 includes the plasma display panel 20, the Y electrode drive circuit 21, the X electrode drive circuit 22, the address electrode drive circuit 23, the discrimination decision circuit 24, the memory 25, the control circuit 26, the scanning circuit 27, and voltage fluctuation balancing units 31 and 32.

A vertical synchronizing signal Vsync, a horizontal synchronizing signal Hsync, a clock signal Clock, and RGB signals each comprised of 8 bits and serving as data signals are supplied to the discrimination decision circuit 24. The discrimination decision circuit 24 writes RGB data in the memory 25 as display data in response to the vertical synchronizing signal Vsync. The control circuit 26 controls the Y electrode drive circuit 21, the X electrode drive circuit 22, the address electrode drive circuit 23, and the scanning circuit 27, and displays the display data stored in the memory 25 on the plasma display panel 20. In conjunction with this, the scanning circuit 27 scans the Y electrodes Y1 through Yn, and the address electrode drive circuit 23 drives the address electrodes A1 through An, thereby together effecting writing electric discharge for writing data in the plasma display panel 20. In the display cells where data were written, further, sustain electric discharge is generated between the Y electrodes Y1 through Yn and the X electrodes X1 through Xn by the Y electrode drive circuit 21 and the X electrode drive circuit 22.

The voltage fluctuation balancing units 31 and 32 adjust wiring inductance and the like with respect to the Y electrodes Y1 through Yn and the X electrodes X1 through Xn, respectively, so that voltage drops along the wiring paths become substantially the same.

In the following, an embodiment of the voltage fluctuation balancing units 31 and 32 will be described.

Figure 5A:
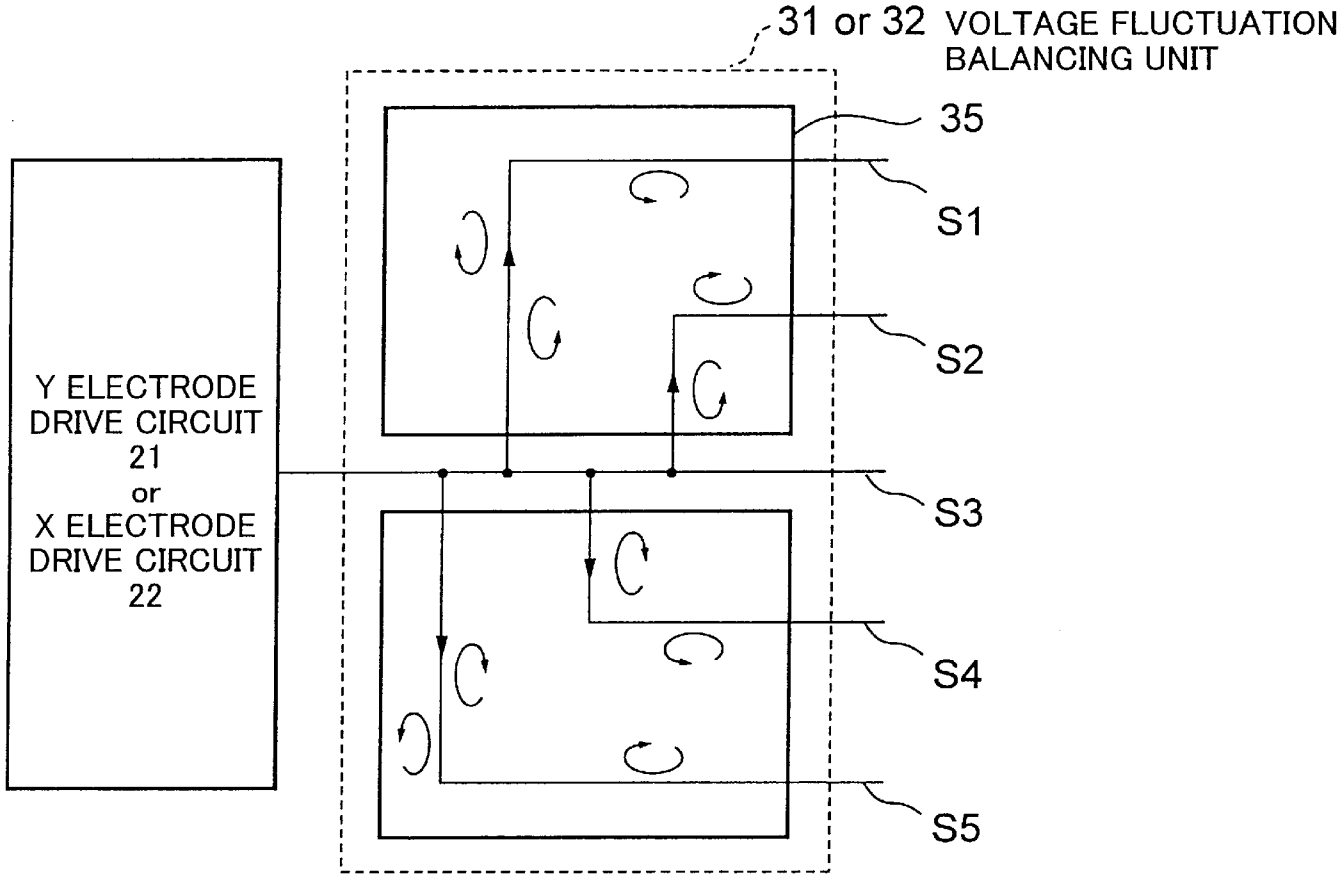
FIGS. 5A and 5B are drawings showing a configuration of a first embodiment of a voltage fluctuation balancing unit.
Figure 5B:
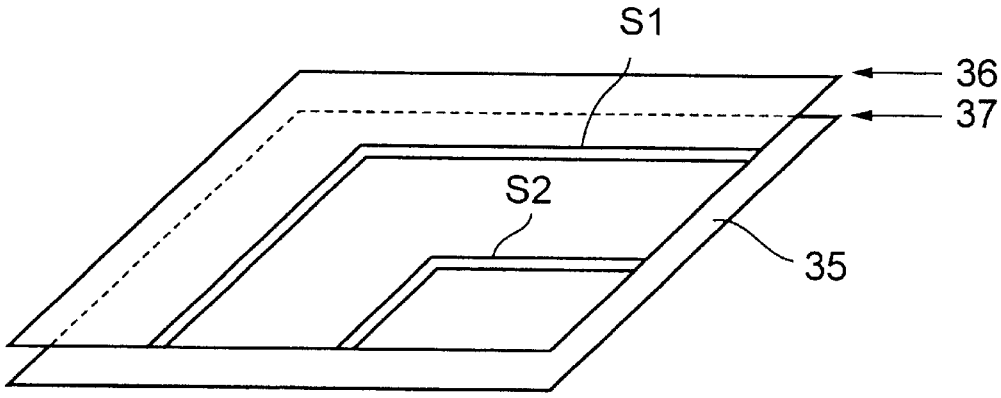

FIGS. 5A and 5B are drawings showing a configuration of a first embodiment of the voltage fluctuation balancing unit. The voltage fluctuation balancing unit 31 or 32 includes wiring lines S1 through S5 and conductive boards 35. In the case of the voltage fluctuation balancing unit 31 for the Y electrodes Y1 through Yn, the wiring lines S1 through S5 correspond to the wiring lines y1 through yn, which are connected to the respective Y electrodes Y1 through Yn through the scanning circuit 27. In the case of the voltage fluctuation balancing unit 32 for the X electrodes X1 through Xn, the wiring lines S1 through S5 correspond to the X electrodes X1 through Xn. For the sake of simplicity of the figure, only 5 wiring lines are shown. In actuality, however, each one of the 5 wiring lines shown in the figure is comprised of a plurality of lines. In total, therefore, the voltage fluctuation balancing units 31 and 32 are provided with wiring lines as many as there are Y electrodes and X electrodes, respectively, in the plasma display panel 20.

FIG. 5B shows a layer structure of part of the voltage fluctuation balancing unit 31 or 32.

As shown in FIG. 5B, the voltage fluctuation balancing unit 31 or 32 includes at least one wiring layer 36 and an eddy current layer 37 which are provided on a printed circuit board. Wiring lines (for example, S1 and S2) are laid out in at least one wiring layer 36, and the conductive board 35 is formed in the eddy current layer 37. The conductive board 35 is made of conductive material such as copper. When a current runs through the wiring lines, an eddy current will be generated in such a direction as to cancel the magnetic field generated by the running current.

Such eddy currents are illustratively shown in FIG. 5A as arrows. In FIG. 5A, if the direction of the currents running through the wiring lines S1 or S5 is reversed (the direction of electric currents alternates during sustain discharge), the direction of the eddy currents illustratively shown is also reversed as a natural consequence.

When currents run through the wiring lines to generate eddy currents in such a direction as to cancel the magnetic field generated by the running currents, the wiring inductance of the wiring lines are reduced. An effect of this wiring inductance reduction increases as the lengths of the wiring lines increase. Therefore, wiring inductance is reduced greatly with respect to wiring lines having relatively long wire lengths, and is not reduced so much with respect to wiring lines having relatively short wire lengths. It is thus possible to reduce the wiring inductance by the larger extent the longer the wire length becomes. As a result, voltage drops caused by the wiring inductance of wiring lines can be adjusted to be substantially the same.

According to the voltage fluctuation balancing unit of the first embodiment as described above, it is possible to reduce the wiring inductance of each wiring line according to the wiring length thereof by utilizing an effect of the conductive board that generates an eddy current. This makes it possible to make the voltage drops by the wiring inductance substantially the same.

Figure 6:
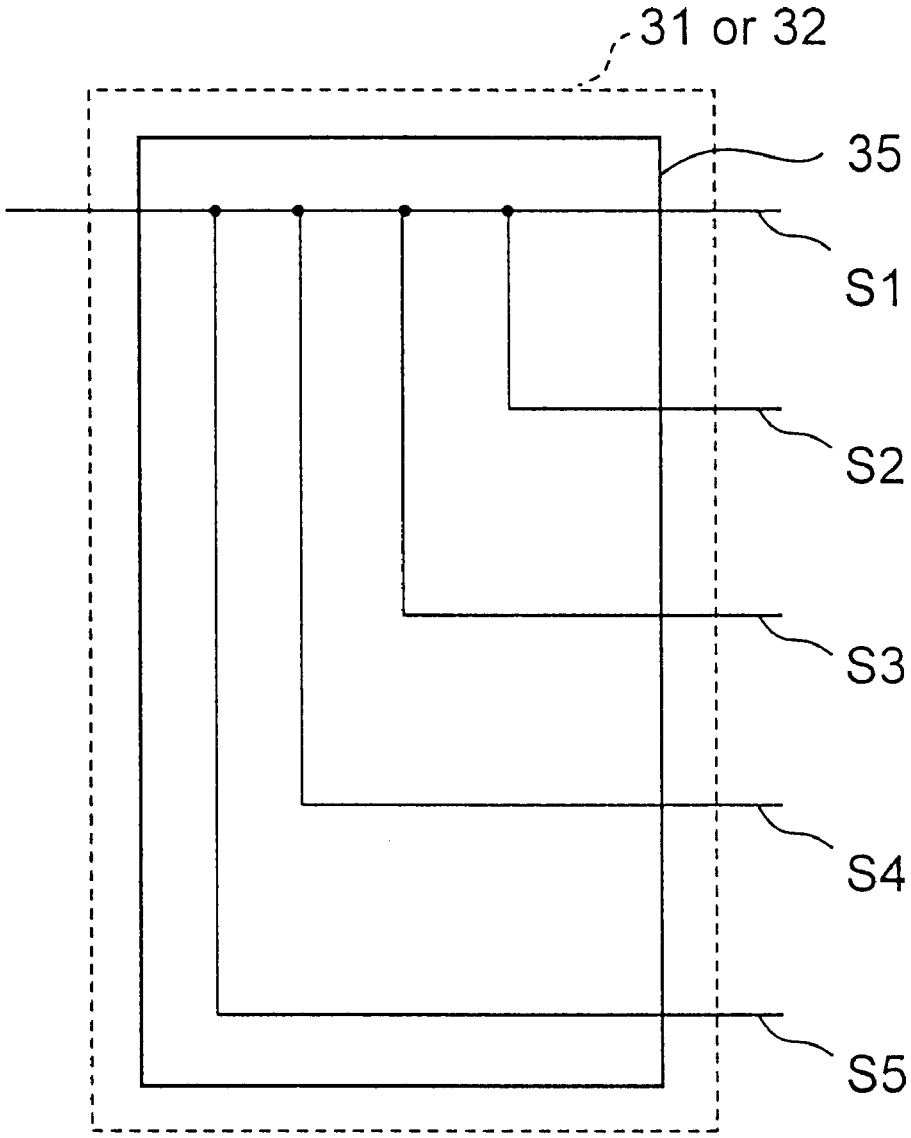
FIG. 6 is a drawing showing another example of the first embodiment of the voltage fluctuation balancing unit.

It should be noted that a wiring pattern of the wiring lines S1 through S5 does not have to extend roughly symmetrically from the center as shown in FIG. 5A, and may have any form. FIG. 6 is a drawing showing another example of the first embodiment of the voltage fluctuation balancing unit. As shown in FIG. 6, the wiring pattern of the wiring lines S1 through S5 may extend to one side. As shown in these examples, the form of the wiring line pattern is not limited to any specific form.

Figure 7:
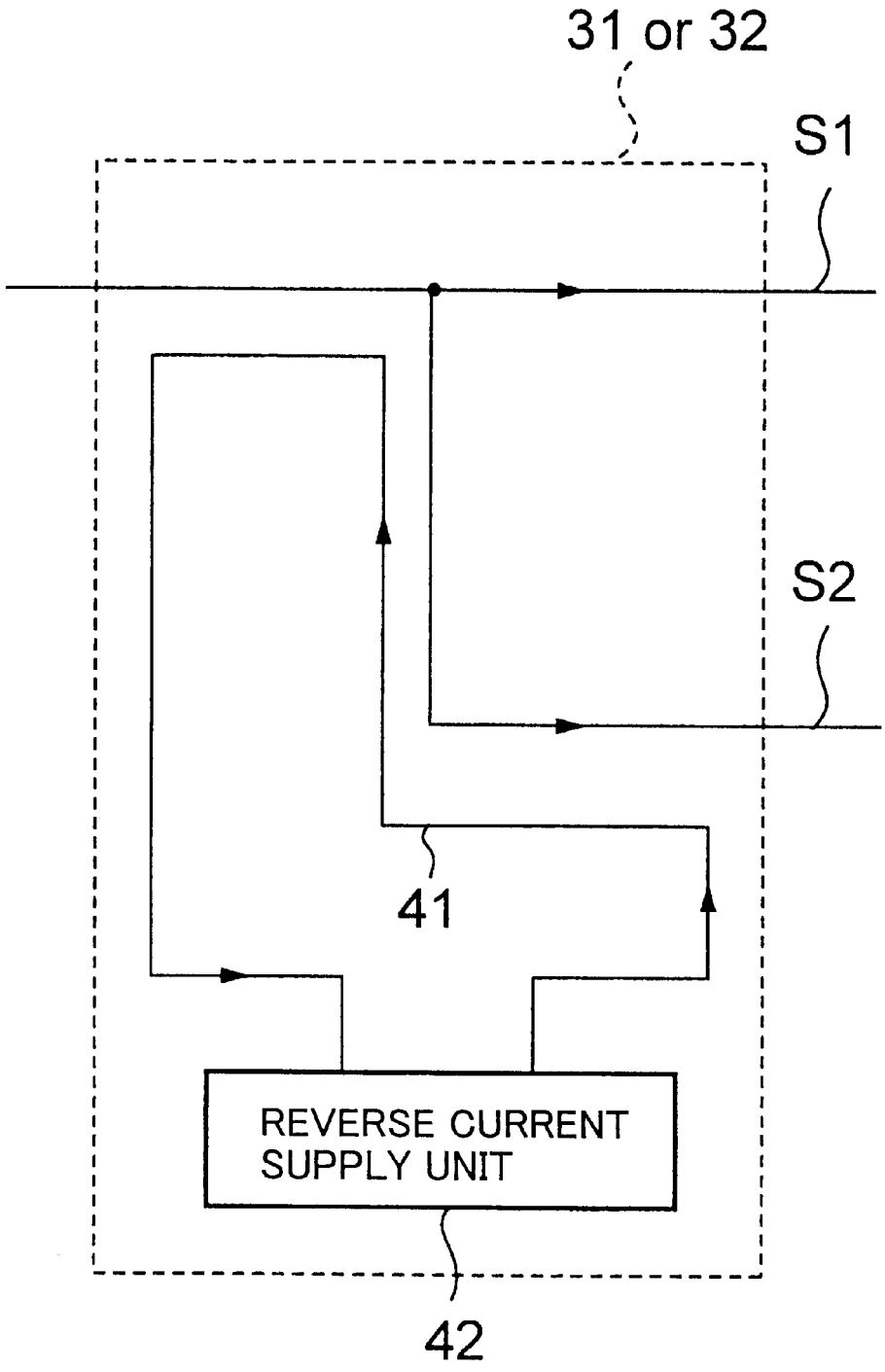
FIG. 7 is a drawing showing a configuration of a second embodiment of the voltage fluctuation balancing unit.

FIG. 7 is a drawing showing a configuration of a second embodiment of the voltage fluctuation balancing unit.

The voltage fluctuation balancing unit 31 or 32 includes wiring lines S1 and S2, a reverse current line 41, and a reverse current supply unit 42. In the case of the voltage fluctuation balancing unit 31 for the Y electrodes Y1 through Yn, the wiring lines S1 and S2 correspond to the wiring lines y1 through yn, which are connected to the respective Y electrodes Y1 through Yn through the scanning circuit 27. In the case of the voltage fluctuation balancing unit 32 for the X electrodes X1 through Xn, the wiring lines S1 and S2 correspond to the X electrodes X1 through Xn. For the sake of simplicity of the figure, only 2 wiring lines are shown. In actuality, however, each one of the 2 wiring lines shown in the figure is comprised of a plurality of lines. In total, therefore, the voltage fluctuation balancing units 31 and 32 are provided with wiring lines as many as there are Y electrodes and X electrodes, respectively, in the plasma display panel 20.

The reverse current supply unit 42 supplies an electric current to the reverse current line 41 where the supplied current runs in a direction opposite to the current running through wiring line S2. If the direction of the current running through the wiring line S2 is reversed (the direction of electric currents alternates during sustain discharge), the direction of the current that is supplied by the reverse current supply unit 42 to the reverse current line 41 is also reversed.

When the current runs through the wiring line S2, and the current is supplied to the reverse current line 41 to run in such a direction as to cancel the magnetic field generated by the former current, the wiring inductance of the wiring line S2 is reduced. The wiring inductance is reduced with respect to the wiring line S2 having a relatively long wire length compared to the wiring line S1. As a result, voltage drops caused by the wiring inductance of wiring lines can be adjusted to be substantially the same. As was described in connection with the first embodiment, the form of the wiring line pattern is not limited to any specific form in the present invention.

Figure 8:
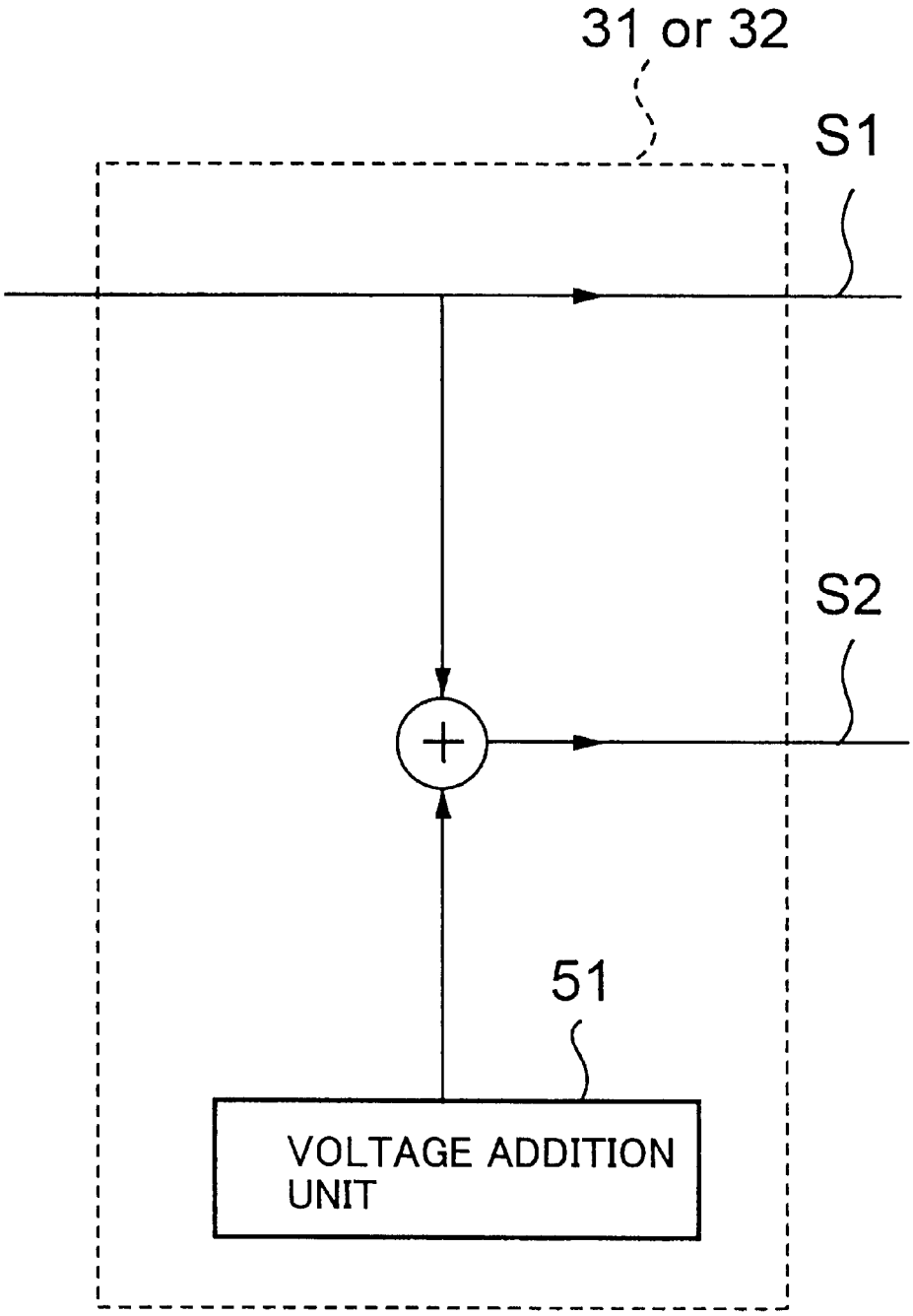
FIG. 8 is a drawing showing a configuration of a third embodiment of a voltage fluctuation balancing unit.

FIG. 8 is a drawing showing a configuration of a third embodiment of a voltage fluctuation balancing unit.

The voltage fluctuation balancing unit 31 or 32 includes wiring S1 and S2 and a voltage addition unit 51. In the case of the voltage fluctuation balancing unit 31 for the Y electrodes Y1 through Yn, the wiring lines SI and S2 correspond to the wiring lines y1 through yn, which are connected to the respective Y electrodes Y1 through Yn through the scanning circuit 27. In the case of the voltage fluctuation balancing unit 32 for the X electrodes X1 through Xn, the wiring lines S1 and S2 correspond to the X electrodes X1 through Xn. For the sake of simplicity of the figure, only 2 wiring lines are shown. In actuality, however, each one of the 2 wiring lines shown in the figure is comprised of a plurality of lines.

The voltage addition unit 51 applies an additional voltage having the same polarity as the voltage applied to the wiring line S2. In detail, the voltage addition unit 51 is comprised of a voltage supply sources that supplies a pulse voltage as does the Y electrode drive circuit 21 or the X electrode drive circuit 22, and supplies the additional voltage in synchronization with the operation of the Y electrode drive circuit 21 or the X electrode drive circuit 22 so as to add this additional voltage. Along the wiring line S2 having a relatively long wire length compared to the wiring line S1, the additional voltage is added to compensate for the voltage drop caused by the wiring inductance, thereby making the voltage drops of wiring lines substantially the same. In the present invention, the form of the wiring line pattern is not limited to any specific form in the present invention.

Figure 9:
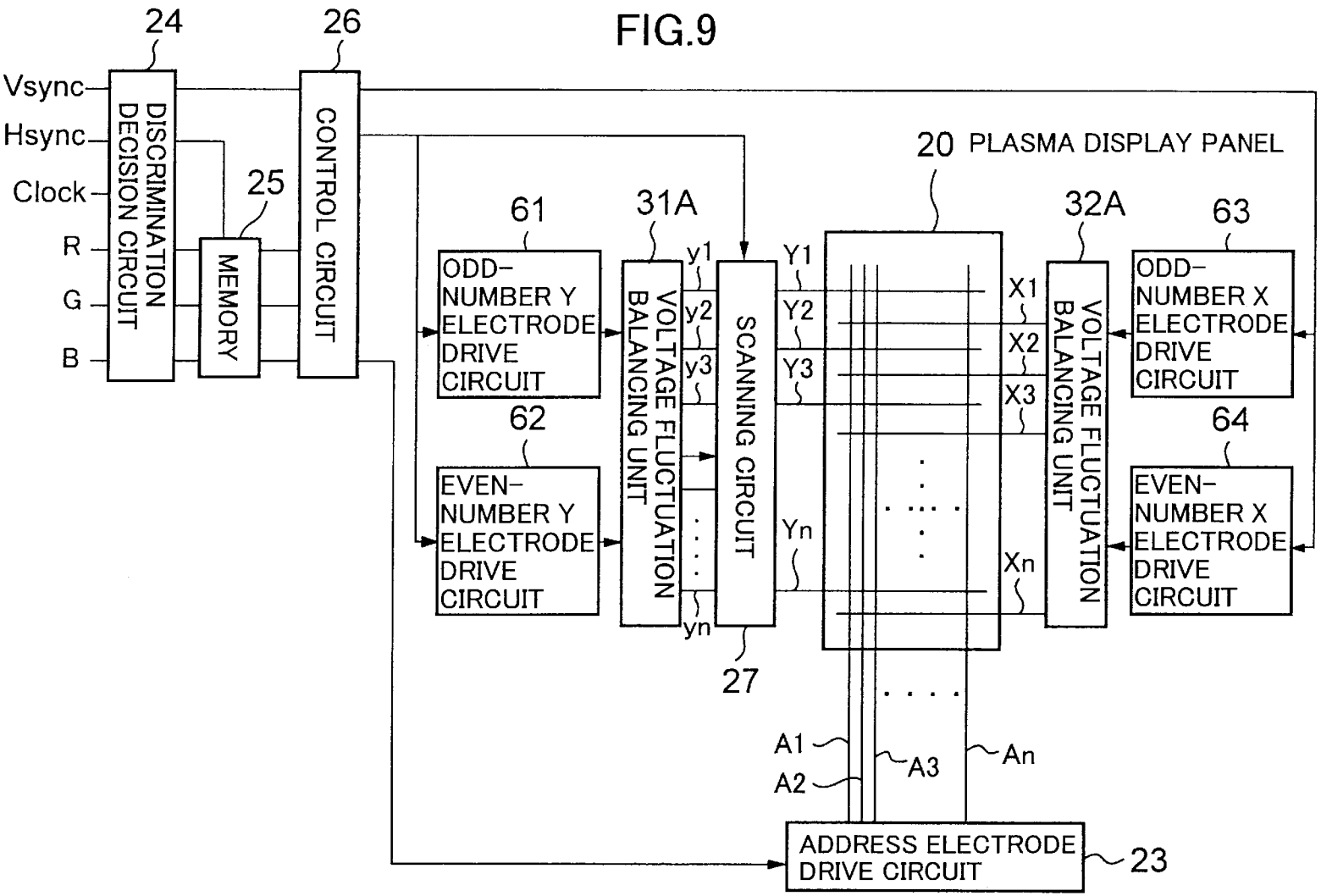
FIG. 9 is a drawing showing another example of a configuration of the plasma display apparatus according to the present invention.

FIG. 9 is a drawing showing another example of a configuration of the plasma display apparatus according to the present invention. In FIG. 9, the same elements as those of FIG. 4 are referred to by the same numerals, and a description thereof will be omitted.

Figure 1:
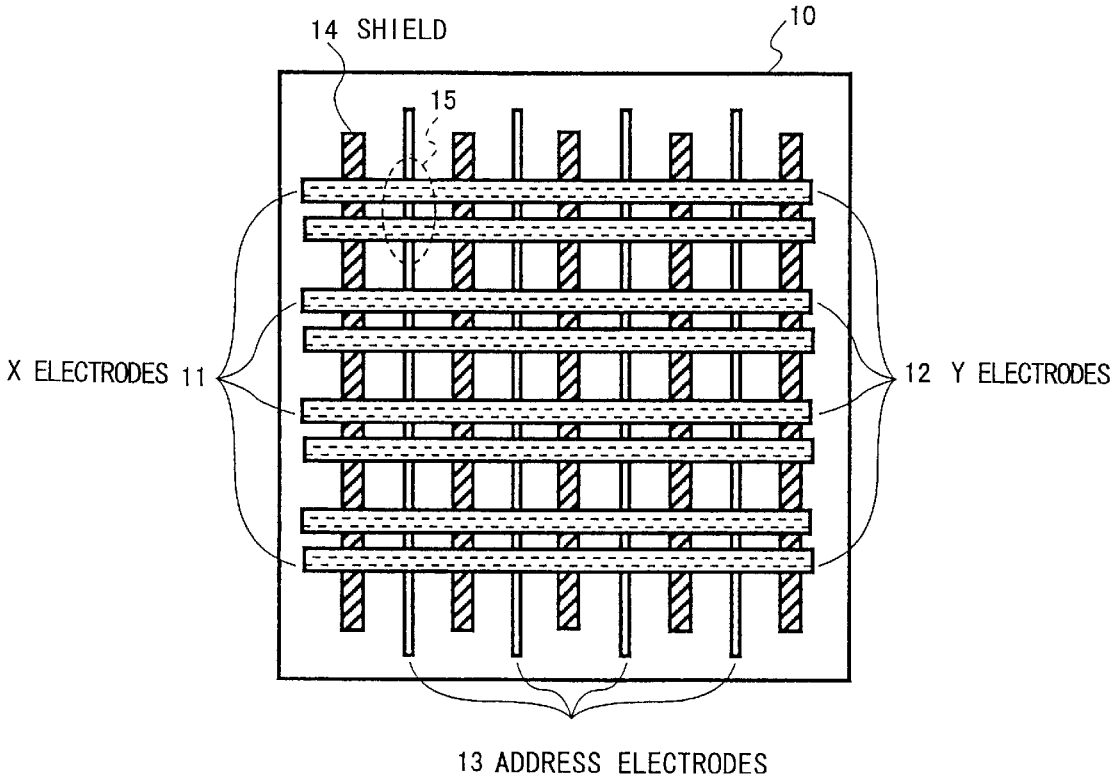
FIG. 1 is a diagram showing a schematic configuration of a plasma display apparatus.
Figure 2:
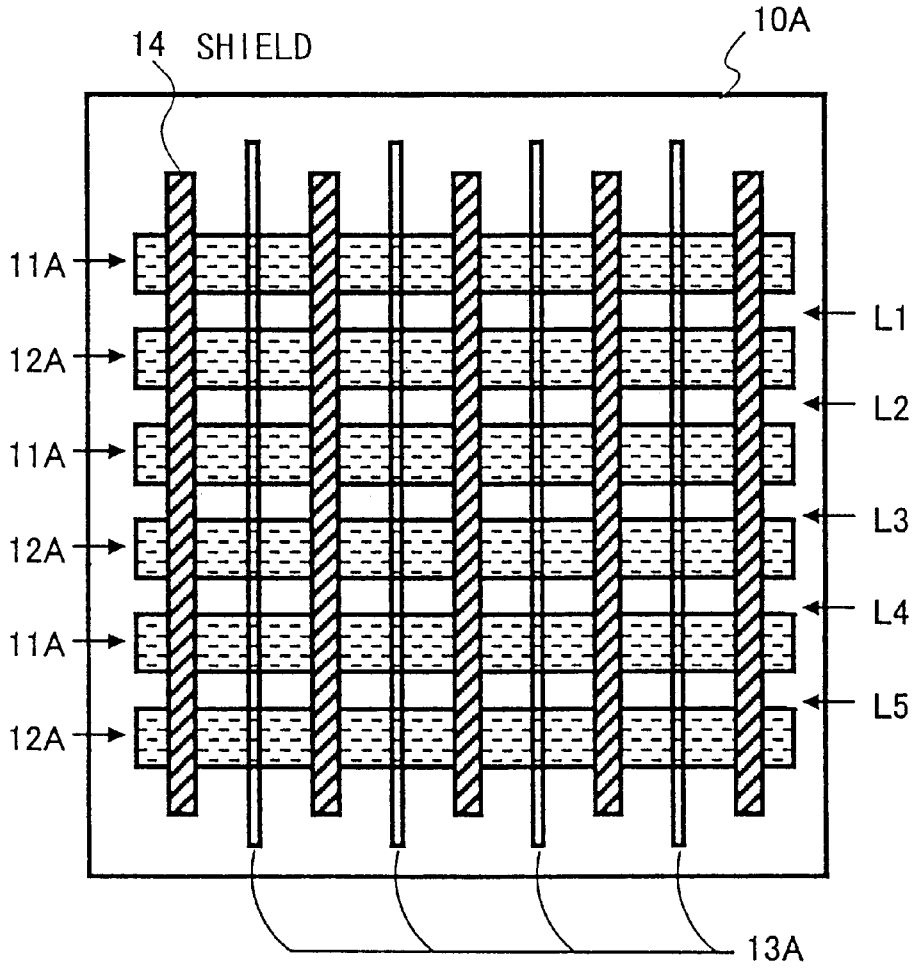
FIG. 2 is a drawing showing another configuration of a display panel unit different from that of FIG. 1.

The plasma display apparatus of FIG. 9 includes the plasma display panel 20, an odd-number Y electrode drive circuit 61, an even-number Y electrode drive circuit 62, an odd-number X electrode drive circuit 63, an even-number X electrode drive circuit 64, the address electrode drive circuit 23, the discrimination decision circuit 24, the memory 25, the control circuit 26, the scanning circuit 27, and voltage fluctuation balancing units 31A and 32A. In the plasma display apparatus of FIG. 9, the respective electrode drive circuits for the Y electrodes and the X electrodes are each divided into a drive circuit for driving odd number electrodes and a drive circuit for driving even number electrodes. Such a configuration is suitable for driving the plasma display panel of the ALIS method shown in FIG. 2.

In the following, embodiments of the voltage fluctuation balancing units 31A and 32A will be described.

Figure 10:
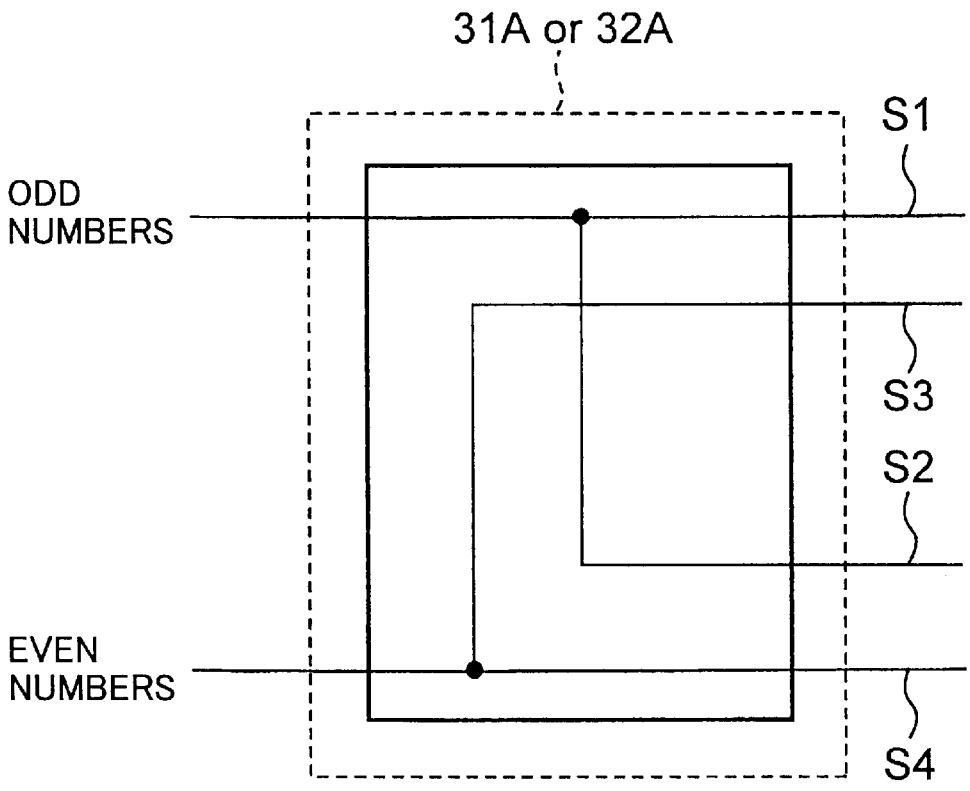
FIG. 10 is a drawing showing a configuration of a fourth embodiment of the voltage fluctuation balancing unit.

FIG. 10 is a drawing showing a configuration of a fourth embodiment of the voltage fluctuation balancing unit.

The voltage fluctuation balancing unit 31A or 32A includes wiring lines S1 through S4 and a conductive board 71. In the case of the voltage fluctuation balancing unit 31A for the Y electrodes Y1 through Yn, the wiring lines S1 through S4 correspond to the wiring lines y1 through yn, which are connected to the respective Y electrodes Y1 through Yn through the scanning circuit 27. In the case of the voltage fluctuation balancing unit 32A for the X electrodes X1 through Xn, the wiring lines S1 through S4 correspond to the X electrodes X1 through Xn. For the sake of simplicity of the figure, only 4 wiring lines are shown. In actuality, however, each one of the 4 wiring lines shown in the figure is comprised of a plurality of lines. The wiring lines S1 and S2 correspond to the odd number electrodes, and the wiring lines S3 and S4 correspond to even number wiring lines.

The conductive board 71 is made of conductive material such as copper. When currents run through the wiring lines, eddy currents will be generated in such a direction as to cancel the magnetic field generated by the running currents.

When currents run through the wiring lines to generate eddy currents in such a direction as to cancel the magnetic field generated by the running currents, the wiring inductance of the wiring lines are reduced. An effect of this wiring inductance reduction increases as the lengths of the wiring lines increase. Therefore, wiring inductance is reduced greatly with respect to wiring lines having relatively long wire lengths, and is not reduced so much with respect to wiring lines having relatively short wire lengths. It is thus possible to reduce the wiring inductance by the larger extent the longer the wire length becomes. As a result, voltage drops caused by the wiring inductance of wiring lines can be adjusted to be substantially the same.

Figure 11:
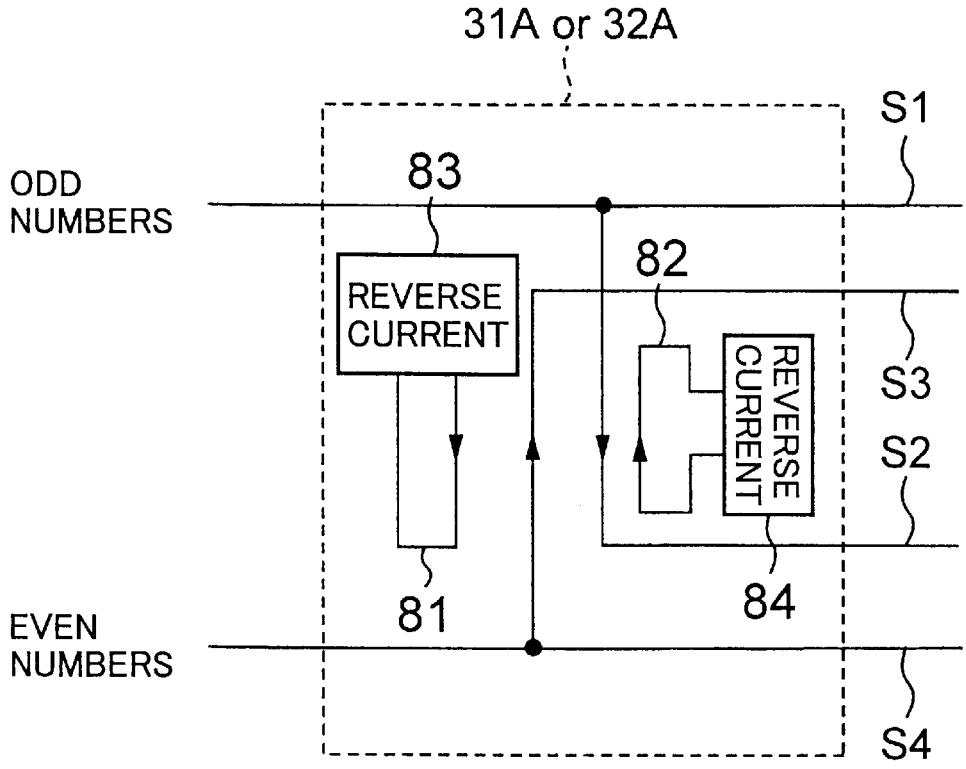
FIG. 11 is a drawing showing a configuration of a fifth embodiment of the voltage fluctuation balancing unit.

FIG. 11 is a drawing showing a configuration of a fifth embodiment of a voltage fluctuation balancing unit.

The voltage fluctuation balancing unit 31A or 32A includes wiring lines S1 through S4, reverse current lines 81 and 82, and reverse current supply units 83 and 84. The wiring lines S1 and S2 correspond to odd-number electrodes, and the wiring lines S3 and S4 correspond to the even-number electrodes. For the sake of simplicity of the figure, only 4 wiring lines are shown. In actuality, however, each one of the 4 wiring lines shown in the figure is comprised of a plurality of lines.

The reverse current supply unit 83 supplies an electric current to the reverse current line 81 where the supplied current runs in a direction opposite to the current running through wiring line S3. If the direction of the current running through the wiring line S3 is reversed (the direction of electric currents alternates during sustain discharge), the direction of the current that is supplied by the reverse current supply unit 83 to the reverse current line 81 is also reversed. By the same token, the reverse current supply unit 84 supplies an electric current to the reverse current line 82 where the supplied current runs in a direction opposite to the current running through wiring line S2.

When currents run through the wiring lines S2 and S3, and currents are supplied to the reverse current lines to run in such a direction as to cancel the magnetic field generated by the former currents, the wiring inductance of the wiring line S2 is reduced. It is thus possible to reduce the wiring inductance with respect to the wiring lines S2 and S3 having relatively long wire lengths compared to the wiring lines S1 and S4, thereby making voltage drops caused by the wiring inductance of wiring lines substantially the same.

Figure 12:
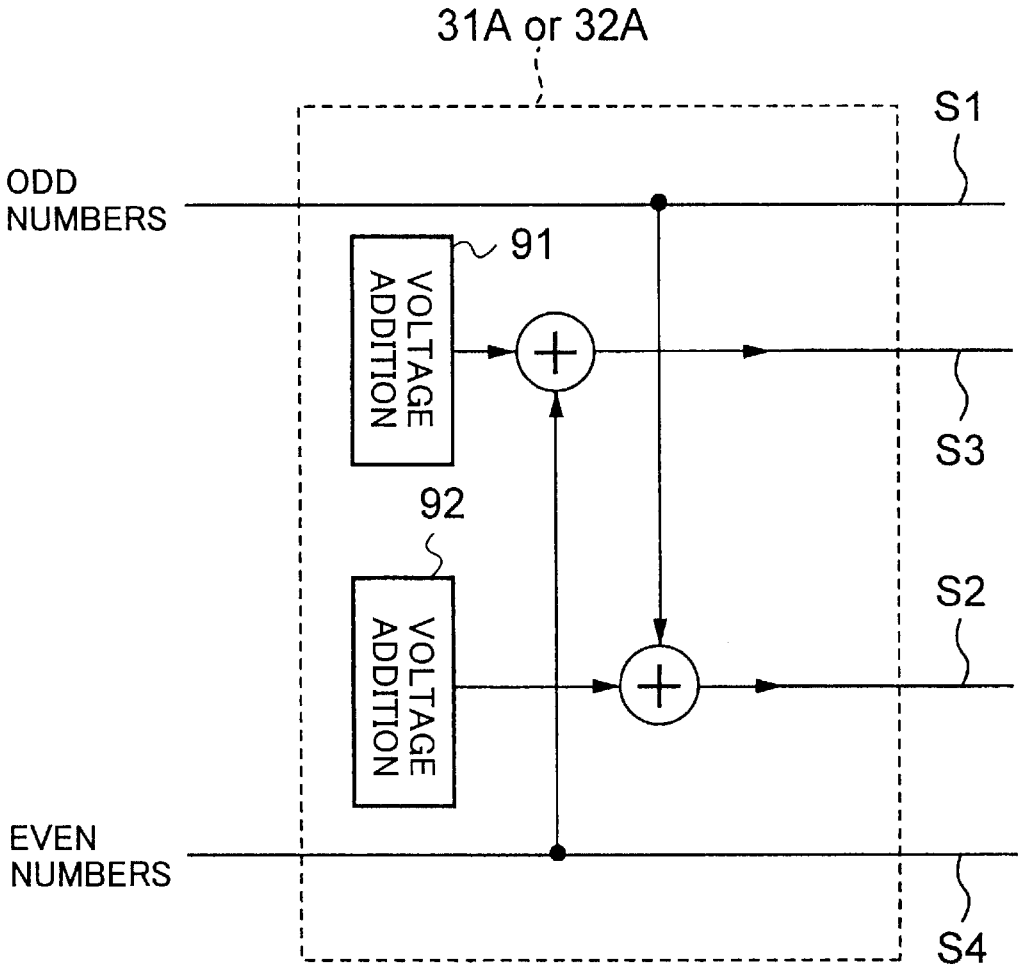
FIG. 12 is a drawing showing a configuration of a sixth embodiment of the voltage fluctuation balancing unit.

FIG. 12 is a drawing showing a configuration of a sixth embodiment of the voltage fluctuation balancing unit.

The voltage fluctuation balancing unit 31A or 32A includes wiring lines S1 through S4 and voltage addition units 91 and 92. The wiring lines S1 and S2 correspond to odd-number electrodes, and the wiring lines S3 and S4 correspond to the even-number electrodes. For the sake of simplicity of the figure, only 4 wiring lines are shown. In actuality, however, each one of the 4 wiring lines shown in the figure is comprised of a plurality of lines.

The voltage addition unit 91 applies an additional voltage having the same polarity as the voltage applied to the wiring line S3 corresponding to the even-number electrodes. In detail, the voltage addition unit 91 is comprised of a voltage supply sources that supplies a pulse voltage as does the even-number Y electrode drive circuit 62 or the even-number X electrode drive circuit 64, and supplies the additional voltage in synchronization with the operation of the even-number Y electrode drive circuit 62 or the even-number X electrode drive circuit 64 so as to add this additional voltage. By the same token, the voltage addition unit 92 applies an additional voltage having the same polarity as the voltage applied to the wiring line S2 corresponding to the odd-number electrodes.

Along the wiring lines S2 and S3 having relatively long wire lengths compared to the wiring lines S1 and S4, the additional voltage is added to compensate for the voltage drops caused by the wiring inductance, thereby making the voltage drops of wiring lines substantially the same.

Figure 13:
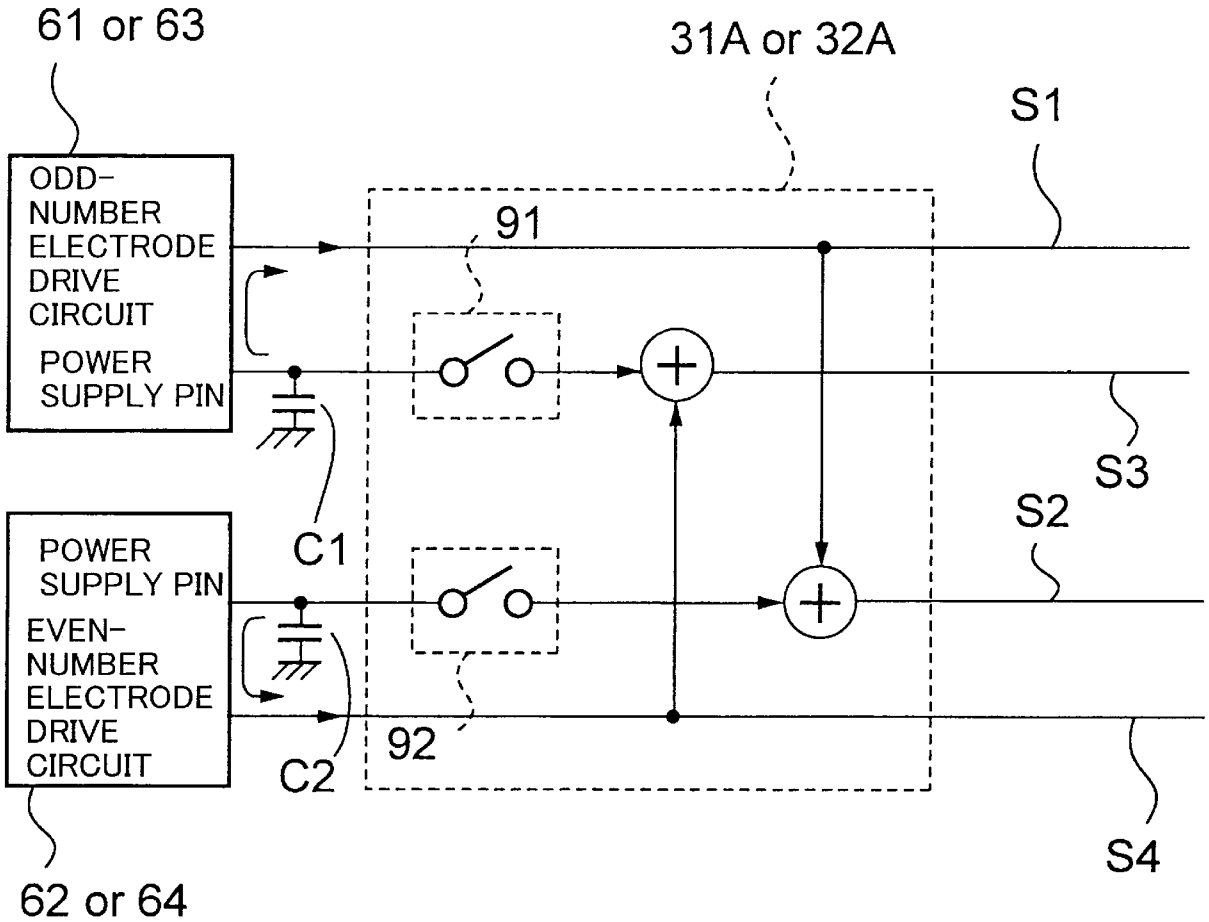
FIG. 13 is a drawing showing a detailed configuration of the sixth embodiment of the voltage fluctuation balancing unit shown in FIG. 12.

FIG. 13 is a drawing showing a detailed configuration of the sixth embodiment of the voltage fluctuation balancing unit shown in FIG. 12.

In the voltage fluctuation balancing unit 31A or 32A of FIG. 13, the voltage addition units 91 and 92 include respective switches. One terminal of a switch is connected to the wiring line S2 or S3, and the other terminal is connected to a power supply pin of an electrode drive circuit. In this configuration, the voltage addition unit 91 that adds a voltage to the wiring line S3 corresponding to the even-number electrodes is connected to the power supply pin of the odd-number Y electrode drive circuit 61 or the odd-number X electrode drive circuit 63, and the voltage addition unit 92 that adds a voltage to the wiring line S2 corresponding to the odd-number electrodes is connected to the power supply pin of the even-number Y electrode drive circuit 62 or the even-number X electrode drive circuit 64.

In the following, operations of the configuration of FIG. 13 will be described by taking the voltage fluctuation balancing unit 31A as an example.

The voltage fluctuation balancing unit 31A is connected to the odd-number Y electrode drive circuit 61 and the even-number Y electrode drive circuit 62. The odd-number Y electrode drive circuit 61 supplies a voltage to the wiring lines S1 and S2 at predetermined timing from a capacitor C1 connected to the power supply pin thereof. At this particular instant, the even-number Y electrode drive circuit 62 is not operating. During this operation cycle, on the X-electrode side, the odd-number X electrode drive circuit 63 is not being driven whereas the even-number X electrode drive circuit 64 is operating to supply a voltage. After this electric discharge is completed, the even-number Y electrode drive circuit 62 supplies a voltage to the wiring lines S3 and S4 from a capacitor C2 connected to the power supply pin thereof, and the odd-number Y electrode drive circuit 61 is placed in an inactive state.

That is, the even-number Y electrode drive circuit 62 is not driven while the odd-number Y electrode drive circuit 61 is operating, and, conversely, the odd-number Y electrode drive circuit 61 is not driven when the even-number Y electrode drive circuit 62 is operating.

By utilizing this operation in the configuration of FIG. 13, the switch of the voltage addition unit 92 is turned on when the odd-number Y electrode drive circuit 61 is operating, thereby supplying electric charge from the capacitor C2 connected to the power supply pin of the even-number Y electrode drive circuit 62 so as to add the voltage. When the even-number Y electrode drive circuit 62 is operating, on the other hand, the switch of the voltage addition unit 91 is turned on, thereby supplying electric charge from the capacitor C1 connected to the power supply pin of the odd-number Y electrode drive circuit 61 so as to add the voltage.

Through the operations described above, a voltage addition unit is efficiently implemented by making use of the capacitors provided in a conventional configuration for the purpose of supplying power.

Figure 14:
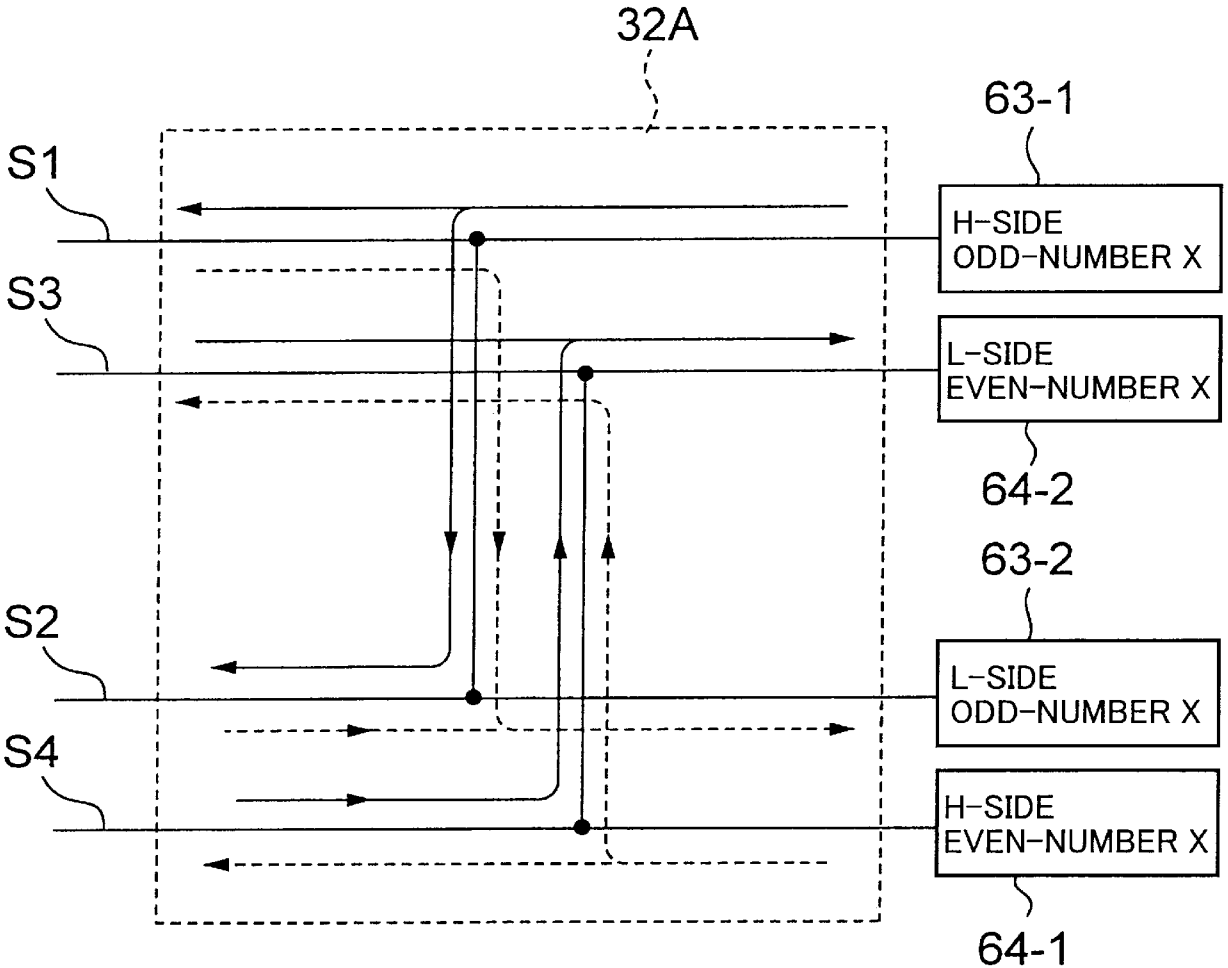
FIG. 14 is a drawing showing a configuration of a seventh embodiment of the voltage fluctuation balancing unit.

FIG. 14 is a drawing showing a configuration of a seventh embodiment of the voltage fluctuation balancing unit.

As described above, the even-number Y electrode drive circuit 62 is not driven while the odd-number Y electrode drive circuit 61 is operating. At this particular instant, as for the X electrodes on the opposite side, the odd-number X electrode drive circuit 63 serves as a ground end for the voltage supplied from the odd-number Y electrode drive circuit 61, and the even-number X electrode drive circuit 64 is driven to supply a voltage, causing a current to run into the even-number Y electrode drive circuit 62 serving as a ground end. After electric discharge is performed in this manner, a current will run from the odd-number X electrode drive circuit 63 into the odd-number Y electrode drive circuit 61 placed in an inactive state, and a current will run into the even-number X electrode drive circuit 64 from the even-number Y electrode drive circuit 62 of an active state, thereby effecting electric discharge.

The configuration of FIG. 14 can effectively prevent voltage drops caused by the wiring inductance by utilizing the operations as described above. FIG. 14 shows the configuration of the seventh embodiment of the voltage fluctuation balancing unit by taking as an example the voltage fluctuation balancing unit 32A provided on the side of X electrodes.

In this configuration, the odd-number X electrode drive circuit 63 is divided into a H-side odd-number X electrode drive circuit 63-1 serving as a voltage supply source and an L-side odd-number X electrode drive circuit 63-2 serving as a ground end. Further, the even-number X electrode drive circuit 64 is divided into an H-side even-number X electrode drive circuit 64-1 serving as a voltage supply source and an L-side even-number X electrode drive circuit 64-2 serving as a ground side.

At a particular discharge timing, currents are supplied to the Y electrode side from the H-side odd-number X electrode drive circuit 63-1, and currents are supplied to the L-side even-number X electrode drive circuit 64-2 from the Y electrode side. The directions of these currents are shown by the solid lines. As can be seen in the figure, the directions of currents are opposite between adjacent wiring lines, so that voltage drops caused by the wiring inductance can be reduced.

At a next discharge timing, currents are supplied to the Y electrode side from the H-side even-number X electrode drive circuit 64-1, and currents are supplied to the L-side odd-number X electrode drive circuit 63-2 from the Y electrode side. The directions of these currents are shown by the dotted lines. As can be seen in the figure, the directions of currents are opposite between adjacent wiring lines, so that voltage drops caused by the wiring inductance can be reduced.

In the seventh embodiment of the voltage fluctuation balancing unit as described above, each electrode drive circuit is divided into an H-side circuitry and an L-side circuitry, and electrode drive circuits and wiring lines are arranged such that currents run in opposite directions between adjacent wiring lines at each electric discharge timing. This makes it possible to cut down the influence of wiring inductance. In conventional configurations, H-side circuitry and L-side circuitry that correspond respectively to the pull-up end and the pull-down end of a push-pull circuit are provided as a single set. As a result, directions of running currents are not opposite in a given locality, so that there is a risk of having an increased inductance. In this embodiment, each electrode drive circuit is divided into the H side and the L side, thereby attaining completely opposite directions.

Although the above description has been provided by taking the X electrode side as an example, it is apparent that the same configuration is equally applicable to the Y electrode side.

Figure 15:
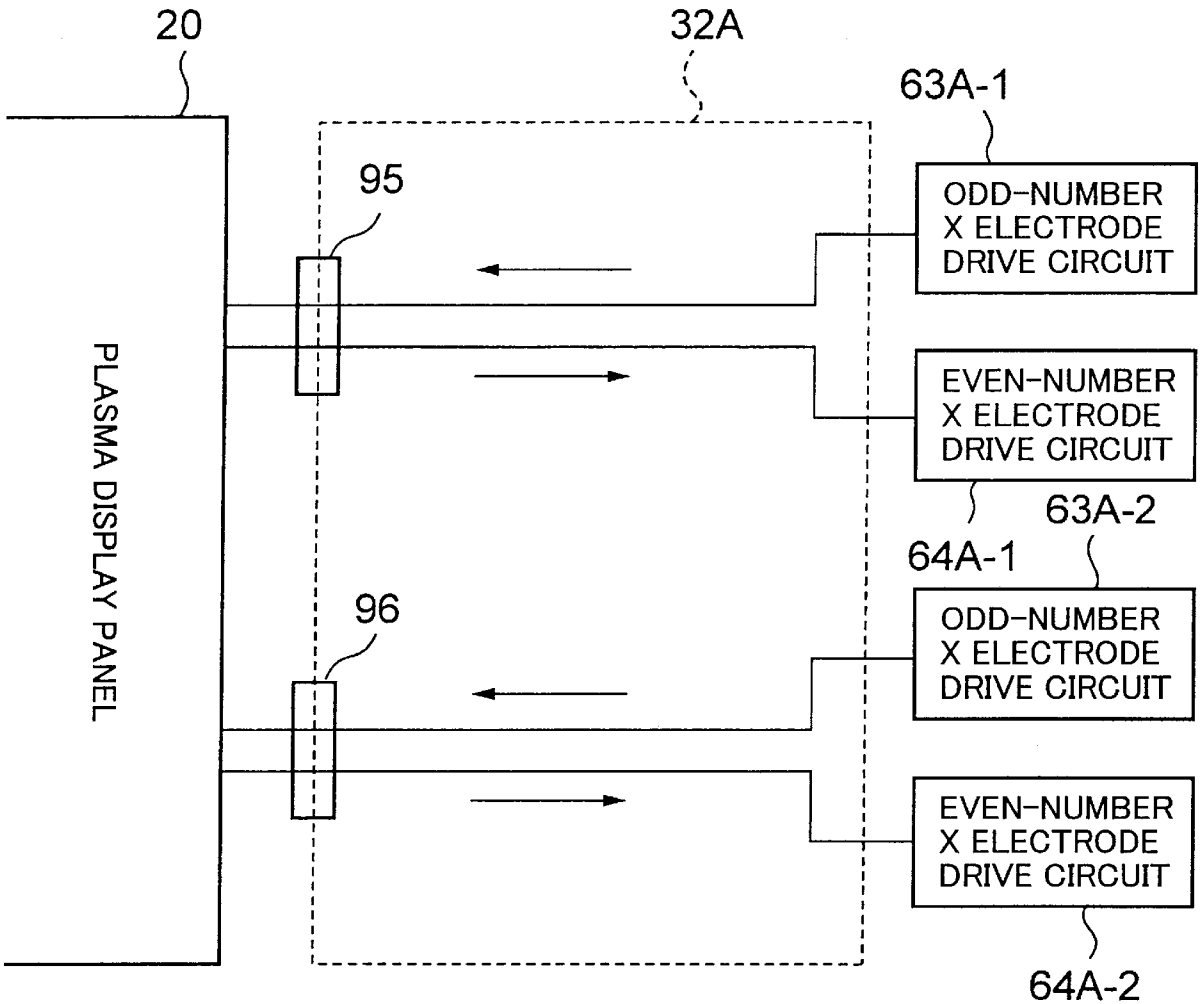
FIG. 15 is a drawing showing a configuration of an eighth embodiment of the voltage fluctuation balancing unit.

FIG. 15 is a drawing showing a configuration of an eighth embodiment of the voltage fluctuation balancing unit.

FIG. 15 shows the configuration of the eighth embodiment of the voltage fluctuation balancing unit by taking as an example the voltage fluctuation balancing unit 32A on the side of X electrodes.

In this configuration, the odd-number X electrode drive circuit 63 is divided into a first odd-number X electrode drive circuit 63A-1 and a second odd-number X electrode drive circuit 63A-2, and the even-number X electrode drive circuit 64 is divided into a first even-number X electrode drive circuit 64A-1 and a second even-number X electrode drive circuit 64A-2. In FIG. 15, a connector 95 is provided for the wiring lines that drive all electrodes in the upper half of the plasma display apparatus, and a connector 96 is provided for the wiring lines that drive all the electrodes in the lower half of the plasma display apparatus.

At a particular electric discharge timing, currents are supplied to the Y electrode side from the odd-number X electrode drive circuits 63A-1 and 63A-2, and currents are supplied to the even-number X electrode drive circuits 64A-1 and 64A-2 from the Y electrode side. These currents are illustrated by the solid lines. As can be seen from the figure, the directions of currents are opposite between adjacent wiring lines, so that the voltage drop by the wiring inductance can be reduced. Division of each electrode drive circuit into a plurality of circuitries is significant when the connector arrangement of the electrodes extending to the plasma display panel 20 is taken into consideration. Namely, if connectors are provided at two separate positions as shown in FIG. 15, division of each electrode drive circuit into two circuitries makes it possible to eliminate redundant detours of wiring lines and to make the currents run in opposite directions between adjacent wiring lines, thereby suppressing an adverse effect of wiring inductance.

As described above, the seventh embodiment of the voltage fluctuation balancing unit divides each electrode drive circuit into a plurality of circuitries, and arranges each electrode drive circuit and wiring lines in such a manner that currents run in opposite directions between adjacent wiring lines at each electric discharge timing. This provides a basis for reducing the effect of wiring inductance.

Although the above description has been provided by taking the X electrode side as an example, it is apparent that the same configuration is equally applicable to the Y electrode side.

Figure 16:
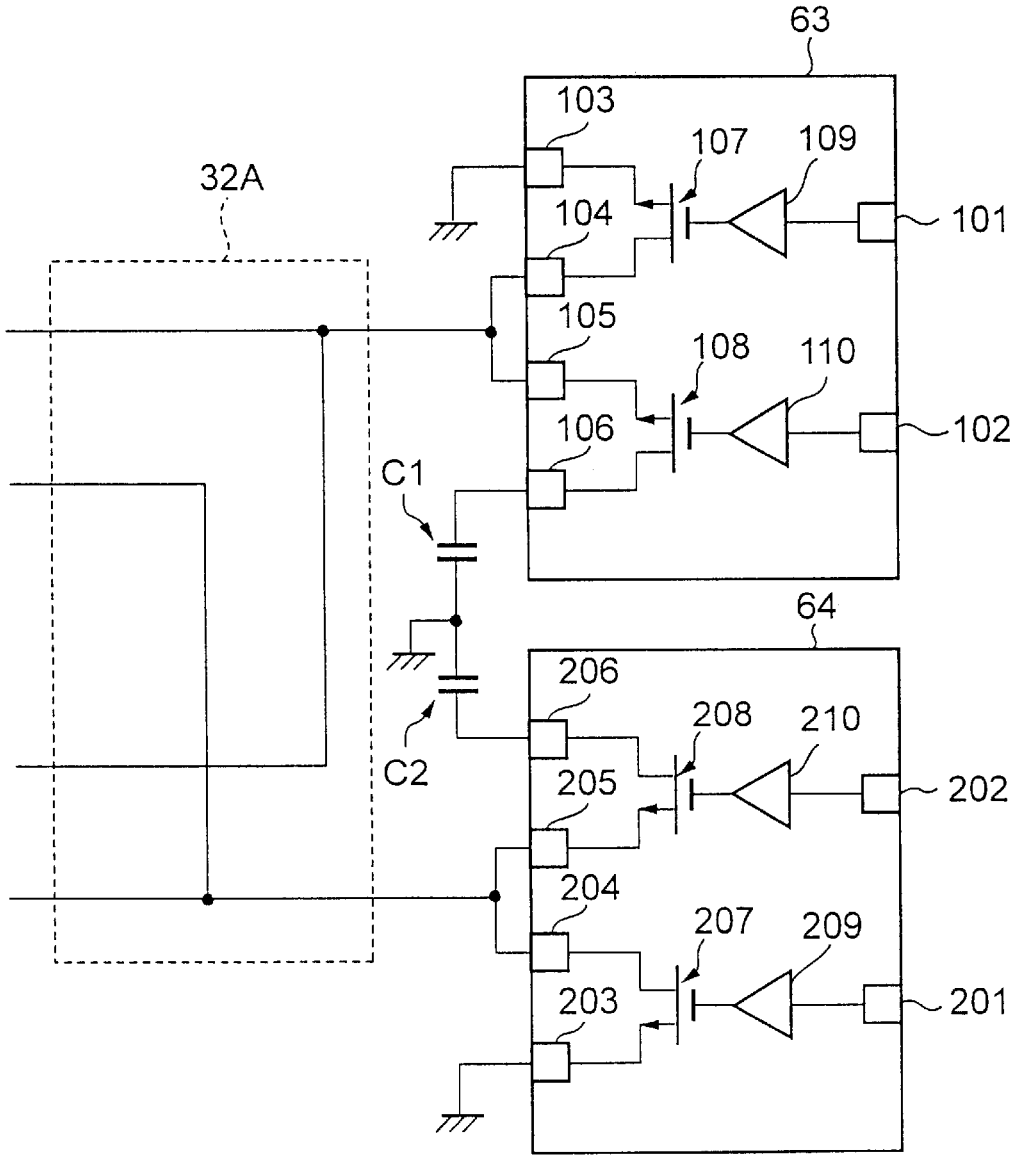
FIG. 16 is a circuit diagram showing a configuration of an odd-number X electrode drive circuit and an even-number X electrode drive circuit.

FIG. 16 is a circuit diagram showing a configuration of the odd-number X electrode drive circuit 63 and the even-number X electrode drive circuit 64.

The odd-number X electrode drive circuit 63 of FIG. 16 is implemented by using a power module or hybrid IC, and includes an L-side input pin 101, an H-side input pin 102, a ground pin 103, an L-side output pin 104, an H-side output pin 105, a power supply pin 106, switching devices 107 and 108, and drive circuits 109 and 110. The even-number X electrode drive circuit 64 is implemented by using a power module or hybrid IC, and includes an L-side input pin 201, an H-side input pin 202, a ground pin 203, an L-side output pin 204, an H-side output pin 205, a power supply pin 206, switching devices 207 and 208, and drive circuits 209 and 210.

The odd-number X electrode drive circuit 63 and the even-number X electrode drive circuit 64 of the present invention have pins thereof provided in a symmetrical arrangement between the odd-number X electrode drive circuit 63 and the even-number X electrode drive circuit 64, as shown in FIG. 16. That is, the odd-number X electrode drive circuit 63 has the ground pin thereof provided at the top and the L-side output pin thereof next to the ground pin, whereas the even-number X electrode drive circuit 64 has the ground pin thereof provided at the bottom, flanked by the L-side output pin.

Because of the symmetrical arrangement of pins as described above, it is possible to lay out the wiring lines in voltage fluctuation balancing unit 32A in a balanced manner. This makes it easy to efficiently reduce voltage drops caused by the wiring inductance and to balance the voltage drops. Moreover, it is arranged for electric charge to easily move between the two capacitors C1 and C2, so that the voltage fluctuation can be reduced.

As described hereinbefore, the present invention provides a voltage fluctuation balancing unit in order to reduce a voltage drop caused by wiring inductance. The voltage fluctuation balancing unit includes a conductive plate layer overlapping at least part of the wiring lines so as to reduce a variation in voltage drops by eddy currents generated in the conductive plate layer in response to currents running through the wiring lines. Alternatively, the voltage fluctuation balancing unit provides a reverse current to a reverse current line laid out along a wiring line, thereby reducing a variation in voltage drops. Alternatively, the voltage fluctuation balancing unit applies a voltage having the same polarity as a voltage applied to wiring lines, thereby reducing a variation in voltage drops.

The configurations as described above provide a plasma display panel apparatus in which a variation in voltage drops produced in accordance with wire lengths is reduced, thereby improving the quality of images.

Further, the present invention is not limited to these embodiments, but various variations and modifications may be made without departing from the scope of the present invention.

The present application is based on Japanese priority application No. 2000-391389 filed on Dec. 22, 2000, with the Japanese Patent Office, the entire contents of which are hereby incorporated by reference.

What is claimed is:

1. A plasma display apparatus, comprising:

a plurality of first electrodes;

a plurality of second electrodes which are arranged in substantially parallel to said plurality of first electrodes and generate electric discharge with said plurality of first electrodes at gaps therebetween;

a first drive circuit which applies an electric discharge voltage to said plurality of first electrodes;

a second drive circuit which applies an electric discharge voltage to said plurality of second electrodes; and voltage fluctuation balancing units which are provided for wiring lines between the first and second drive circuits and the first and second electrodes, and each of which has a conductive plate layer overlapping at least part of the wiring lines so as to reduce a variation in voltage drops specific to the wiring lines by eddy currents generated in the conductive plate layer in response to currents running through the wiring lines.

2. A plasma display apparatus, comprising:

a plurality of first electrodes;

a plurality of second electrodes which are arranged in substantially parallel to said plurality of first electrodes and generate electric discharge with said plurality of first electrodes at gaps therebetween;

a first drive circuit which applies an electric discharge voltage to said plurality of first electrodes;

a second drive circuit which applies an electric discharge voltage to said plurality of second electrodes; and voltage fluctuation balancing units which are provided for wiring lines between the first and second drive circuits and the first and second electrodes, and each of which includes a reverse current line laid out along one of the wiring lines and having a current running therethrough in a direction opposite to a current running through the one of the wiring lines so as to reduce a variation in voltage drops specific to the wiring lines.

3. A plasma display apparatus, comprising:

a plurality of first electrodes;

a plurality of second electrodes which are arranged in substantially parallel to said plurality of first electrodes and generate electric discharge with said plurality of first electrodes at gaps therebetween;

a first drive circuit which applies an electric discharge voltage to said plurality of first electrodes;

a second drive circuit which applies an electric discharge voltage to said plurality of second electrodes; and voltage fluctuation balancing units which are provided for wiring lines between the first and second drive circuits and the first and second electrodes and each of which applies a voltage that has an identical polarity to a voltage applied to at least one of the wiring lines to said at least one of the wiring lines additionally, thereby reducing a variation in voltage drops specific to the wiring lines.

4. A plasma display apparatus, comprising:

a plurality of first electrodes;

a plurality of second electrodes which are arranged in substantially parallel to said plurality of first electrodes and generate electric discharge with said plurality of first electrodes at gaps therebetween;

a first drive circuit which applies an electric discharge voltage to odd-number electrodes of said plurality of first electrodes; and a second drive circuit which applies an electric discharge voltage to even-number electrodes of said plurality of first electrodes, wherein said first drive circuit and said second drive circuit have a mutually symmetrical input/output pin arrangement.

5. A plasma display apparatus, comprising:

a plurality of first electrodes;

a plurality of second electrodes which are arranged in substantially parallel to said plurality of first electrodes and generate electric discharge with said plurality of first electrodes at gaps therebetween;

a first integrated circuit which includes a high-side odd-number electrode drive circuit for supplying a high voltage to odd-number electrodes of the first electrodes and a low-side even-number electrode drive circuit for supplying a low voltage to even-number electrodes of the first electrodes; and a second integrated circuit which includes a low-side odd-number electrode drive circuit for supplying a low voltage to the odd-number electrodes of the first electrodes and a high-side even-number electrode drive circuit for supplying a high voltage to the even-number electrodes of the first electrodes.

6. A plasma display apparatus which includes a plurality of first electrodes and a plurality of second electrodes that are arranged in substantially parallel to said plurality of first electrodes and generate electric discharge with said plurality of first electrodes at gaps therebetween, comprising:

a plurality of blocks into which said plurality of first electrodes are divided, wherein each block is provided with an odd-number electrode drive circuit for driving odd-number electrodes of the first electrodes and an even-number electrode drive circuit for driving even-number electrodes of the first electrodes.

* * * * *